US010941567B2

(12) United States Patent
Harris et al.

(10) Patent No.: US 10,941,567 B2
(45) Date of Patent: Mar. 9, 2021

(54) WALL CONSTRUCTION SYSTEM

(71) Applicant: E. Dillon & Company, Swords Creek, VA (US)

(72) Inventors: Thomas Harmon Harris, Rosedale, VA (US); Mike Miller, Honaker, VA (US); Mark J. Norden, Abingdon, VA (US)

(73) Assignee: E. DILLON & COMPANY, Swords Creek, VA (US)

( * ) Notice: Subject to any disclaimer, the term of this patent is extended or adjusted under 35 U.S.C. 154(b) by 208 days.

(21) Appl. No.: 16/402,821

(22) Filed: May 3, 2019

(65) Prior Publication Data

US 2019/0257080 A1 Aug. 22, 2019

Related U.S. Application Data

(63) Continuation-in-part of application No. 14/289,058, filed on May 28, 2014, now Pat. No. 10,329,911.

(51) Int. Cl.

| | |
|---|---|
| ***E04B 2/08*** | (2006.01) |
| ***E04B 2/18*** | (2006.01) |
| *E21F 17/103* | (2006.01) |
| *E04B 2/02* | (2006.01) |

(52) U.S. Cl.

CPC ..... *E04B 2/08* (2013.01); *E04B 2/18* (2013.01); *E04B 2002/0208* (2013.01); *E21F 17/103* (2013.01)

(58) Field of Classification Search

CPC ..... E04B 2/08; E04B 2/18; E04B 2002/0208; E21F 17/103

See application file for complete search history.

(56) References Cited

U.S. PATENT DOCUMENTS

| | | | | | |
|---|---|---|---|---|---|
| 786,884 | A * | 4/1905 | Faulkner | E04B 1/2403 | 52/289 |
| 800,385 | A * | 9/1905 | Miller | E04B 1/2403 | 52/289 |
| 1,984,393 | A * | 12/1934 | Brown | E04B 2/04 | 52/284 |
| 2,294,776 | A * | 9/1942 | Freeman | E04C 1/42 | 52/591.1 |
| 4,367,615 | A * | 1/1983 | Feldman | E04B 2/18 | 52/591.1 |

(Continued)

*Primary Examiner* — Alfred Basichas

(57) ABSTRACT

A wall construction system including plurality of interlocking concrete blocks. The interlocking blocks include one or more stretcher blocks, corner blocks, and half blocks. The blocks include top and end shear lugs and bottom and end grooves. The bottom grooves accommodate the top shear lugs of blocks in a lower course of stacked blocks. Corner blocks provide a means for creating a corner and turning the direction of a course of blocks by 90 degrees. The interlocking features of the blocks enable dry-stacking in successive courses to construct a wall or multi-wall structure. When stacked end to end in successive rows, the top and end shear lugs of each interlocking block engage complimentary grooves in the underlying, overlying, and adjacent blocks thereby enabling the blocks to rapidly self-align vertically and lock together as they are stacked. The resulting dry-stacked structure exhibits a high lateral resistance to overpressures or transverse loads.

16 Claims, 15 Drawing Sheets

(56) References Cited

U.S. PATENT DOCUMENTS

| | | | | | |
|---|---|---|---|---|---|
| 5,024,035 | A * | 6/1991 | Hanson | E04B 2/18 | 52/309.12 |
| 5,181,362 | A * | 1/1993 | Benitez | E04B 2/18 | 52/578 |
| 5,457,926 | A * | 10/1995 | Jensen | E04B 2/18 | 52/309.4 |
| 5,775,047 | A * | 7/1998 | Jensen | C04B 38/0051 | 106/672 |
| 5,899,040 | A * | 5/1999 | Cerrato | E04B 2/08 | 52/223.7 |
| 6,253,518 | B1 * | 7/2001 | Azar | E04B 2/06 | 52/589.1 |
| 6,962,028 | B2 * | 11/2005 | Banova | E04B 2/44 | 52/379 |
| 2014/0059965 | A1 * | 3/2014 | Edwards | E04B 2/16 | 52/588.1 |

* cited by examiner

WALL CONSTRUCTION SYSTEM

This application is a continuation-in-part of U.S. patent application Ser. No. 14/289,058 filed May 28, 2014, the entire contents of which is incorporated herein in its entirety.

FIELD OF THE INVENTION

The present invention relates to devices for controlling the flow of air in mines or devices for sealing off passageways in mines and particularly to a mine wall or mine seal formed with a plurality of interlocking concrete blocks for high resistance to transverse loads.

BACKGROUND OF THE INVENTION

Walls are typically formed in mine tunnels for ventilation control, such as mine stoppings, or for sealing off worked-out sections of the mine, such as mine seals. Mine stoppings, also known as brattice walls, are frequently constructed in mines to restrict the flow of air to certain passageways in order to maintain a flow of air to the mine face and all portions of the mine that are actively used by mine personnel. Mine seals are typically constructed to permanently seal off worked-out or abandoned areas of mines.

Previously, materials used to construct mine seals typically included conventional concrete blocks or prefabricated blocks or panels formed of foam or composites. However, the Sago mine disaster, which involved the failure of a mine seal formed of a dense foam product, proved the futility of constructing mine seals with foam. In that instance, an explosion occurred in a mined-out area that had been sealed only a short time before the disaster. Although mine seals may be constructed of conventional concrete blocks, conventional concrete blocks do not provide the shear strength necessary to withstand high transverse loads or shear forces, such as would be experienced in an explosion.

Accordingly, what is needed is an apparatus for rapidly constructing a wall, such as a mine seal or mine stopping, or a structure, such as a mine safe room or similar wall structure that is capable of withstanding large transverse loads.

SUMMARY OF THE INVENTION

According to the present invention, there is provided a wall construction system including plurality of interlocking concrete blocks. The interlocking blocks include a stretcher block, two corner blocks including a right hand corner block and a left hand corner block, and a half block. The interlocking blocks include a body with a top surface, planar sides, planar ends, and a bottom surface. A top shear lug extends longitudinally along the top of the block. An end shear lug extends vertically along each end of the block. The bottom surface and ends of the block include grooves therein for accommodating the shear lugs of adjacently stacked blocks. The stretcher blocks may include hollow cores extending vertically through the blocks. The corner blocks include an inner side with a notch therein, and provide a means for creating a corner and turning the direction of a course of blocks by 90 degrees. When laying multiple courses of blocks to build a wall, the notch provides clearance for the top shear lug of an underlying block. The interlocking features of the blocks enable dry-stacking in successive courses to construct a wall or multi-wall structure. When stacked end to end in successive rows, the top and end shear lugs of each interlocking block engage complimentary grooves in the underlying, overlying, and adjacent blocks thereby enabling the blocks to rapidly self-align vertically and lock together as they are stacked. The resulting dry-stacked structure exhibits a high resistance to overpressures or transverse loads. The wall construction system enables construction of a multi-wall structure that is capable of retaining its integrity under a transverse load without the use of rebar or similar reinforcement materials.

OBJECTS AND ADVANTAGES

Several advantages are achieved with the wall construction system of the present invention, including:

a. The wall construction system enables construction of a wall or structure that exhibits a high resistance to transverse loads.
b. Shear lugs on the individual blocks interlock with complimentary grooves in adjacent blocks to substantially increase the shear strength of the mine wall.
c. Blocks used to construct any straight-wall portions include ends that are mirror images of one another enabling rapid end-to-end stacking of the blocks without pause to for rotating the blocks to fit the construction.
d. The shear lugs and complimentary grooves on adjacent blocks provide a self-aligning feature to rapidly self-align the blocks to form all or multi-wall structure.
e. The blocks include a self-alignment feature that results in straighter, tighter walls than those constructed of conventional blocks.
f. In a mine application, interlocking shear lugs and complimentary grooves on adjacent blocks result in walls or multi-wall structures with less leakage than similar structures formed of conventional blocks.
g. The wall or multi-wall structure exhibits increased resistance to failure from roof crush, equipment damage, or air pressure differential.

These and other objects and advantages of the present invention will be better understood by reading the following description along with reference to the drawings.

DETAILED DESCRIPTION

Figure 1:
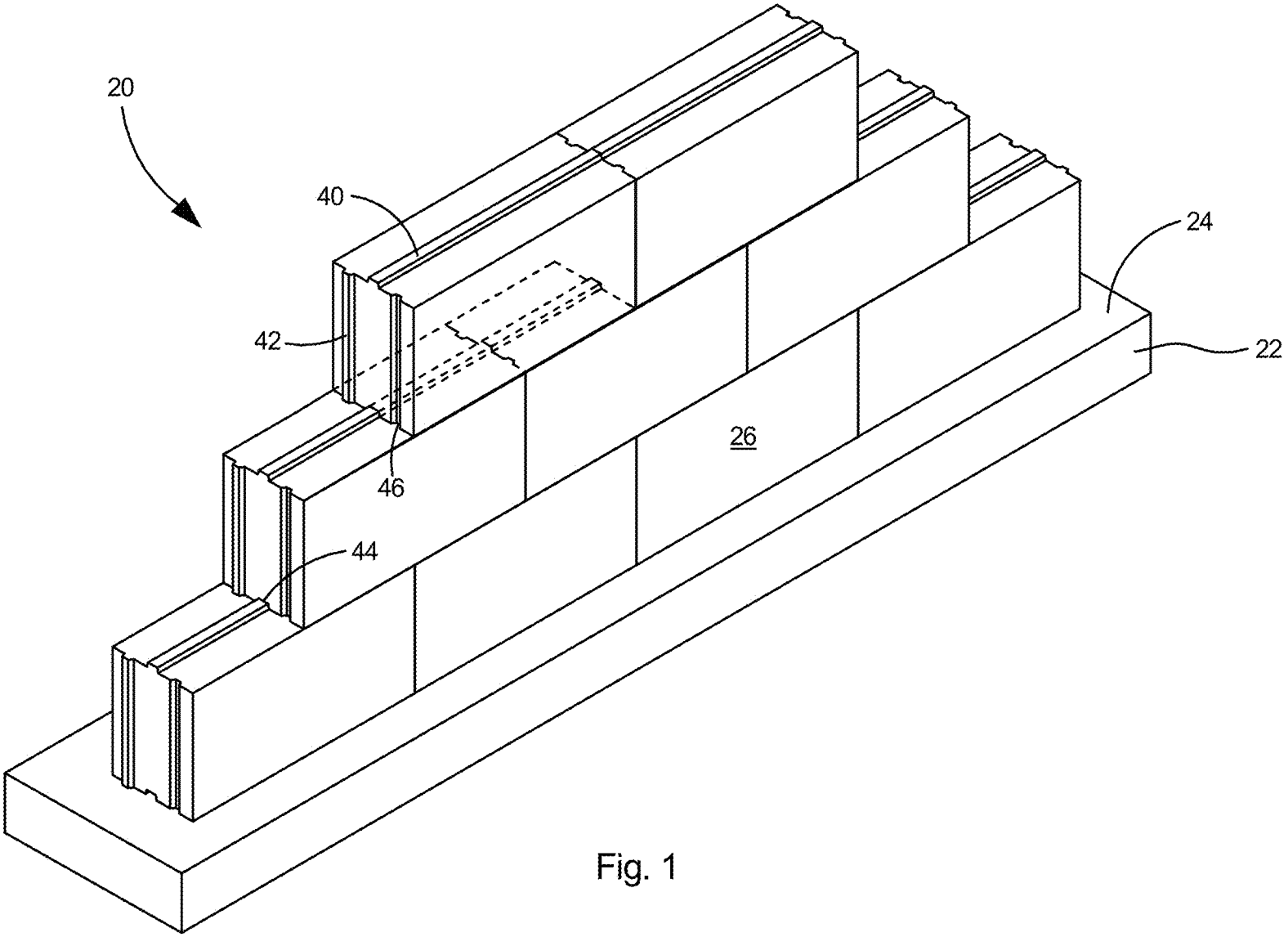
FIG. 1 is a perspective view of partially constructed mine wall according to the present invention.

Referring to FIG. 1 there is shown a portion of a preferred embodiment of a mine wall or seal 20 according to the present invention. The mine seal 20 includes a base 22 with a level top surface 24 and a plurality of interlocking concrete blocks 26 erected on the level surface. The blocks 26 are preferably dry-stacked in successive layers on the level surface 24. The blocks include a rapid alignment mechanism for enabling an installer to align the blocks in each successive row with the row of blocks immediately below it.

Figure 2:
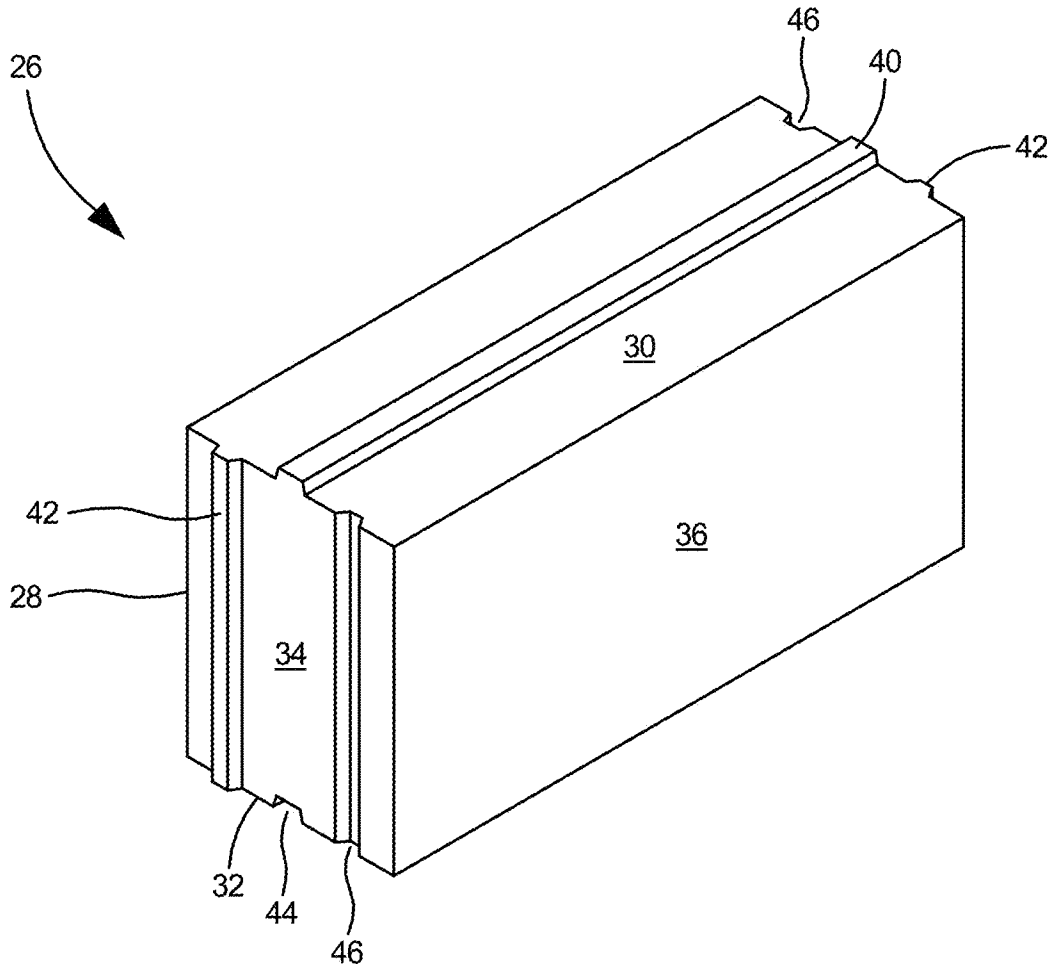
FIG. 2 is a top isometric view of a concrete block used to form the mine wall of FIG. 1.
Figure 5:
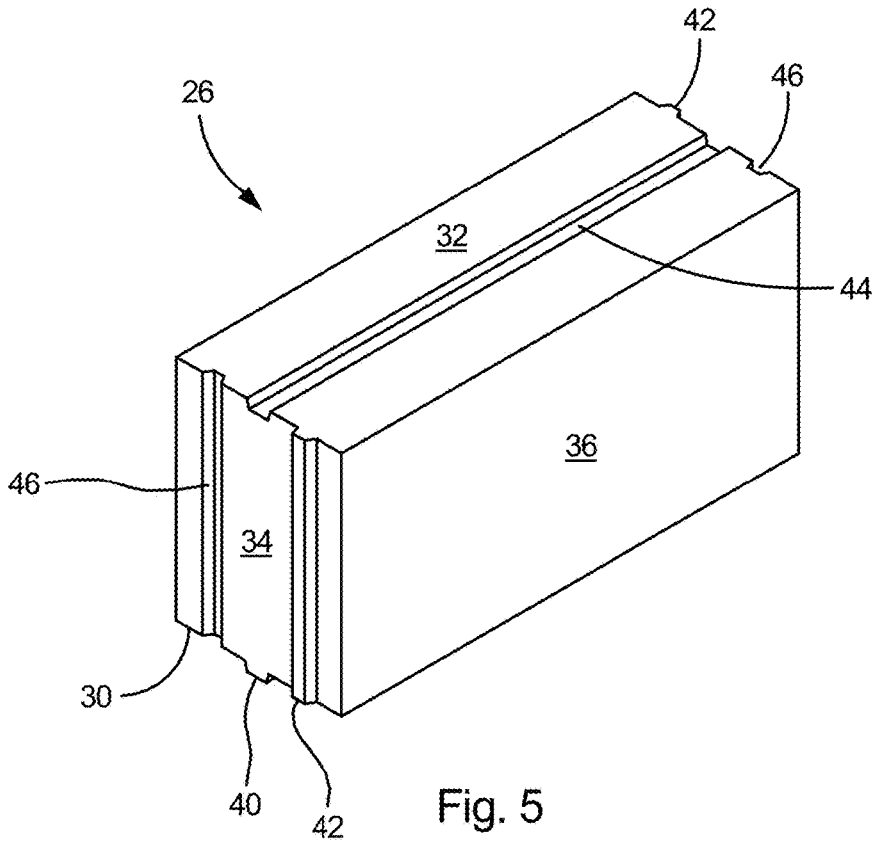
FIG. 5 is a bottom isometric view of the block of FIG. 2.

Referring to FIG. 2, there is shown an interlocking concrete block 26 according to the present invention for use in constructing the mine seal of FIG. 1. The interlocking block 26 includes a solid body 28 with a top surface 30, bottom surface 32, end surfaces 34, and side surfaces 36. The top, bottom, end, and side surfaces 30, 32, 34, and 36 are each substantially planar. A top shear lug 40 extends longitudinally along the top surface 30 and an end shear lug 42 extends vertically along each end 34 of the block. As shown in FIG. 5, a bottom groove 44 extends longitudinally along the bottom surface 32 of the block 26 and an end groove 46 extends vertically along each end surface 34.

Figure 3:
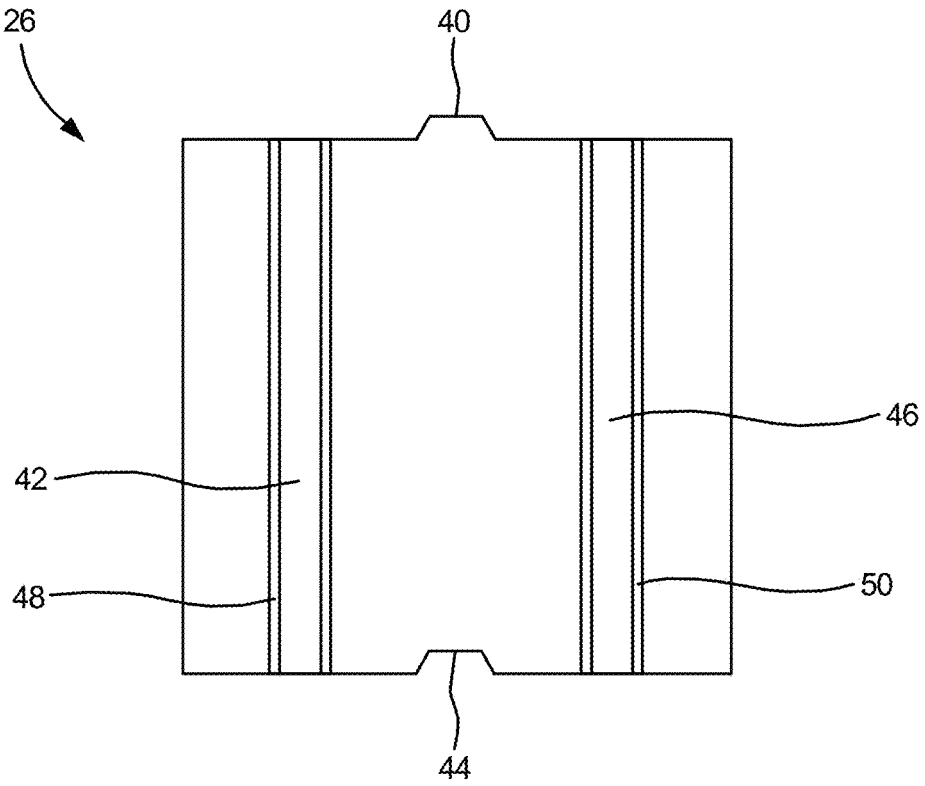
FIG. 3 is an end view of the block of FIG. 2.
Figure 3A:
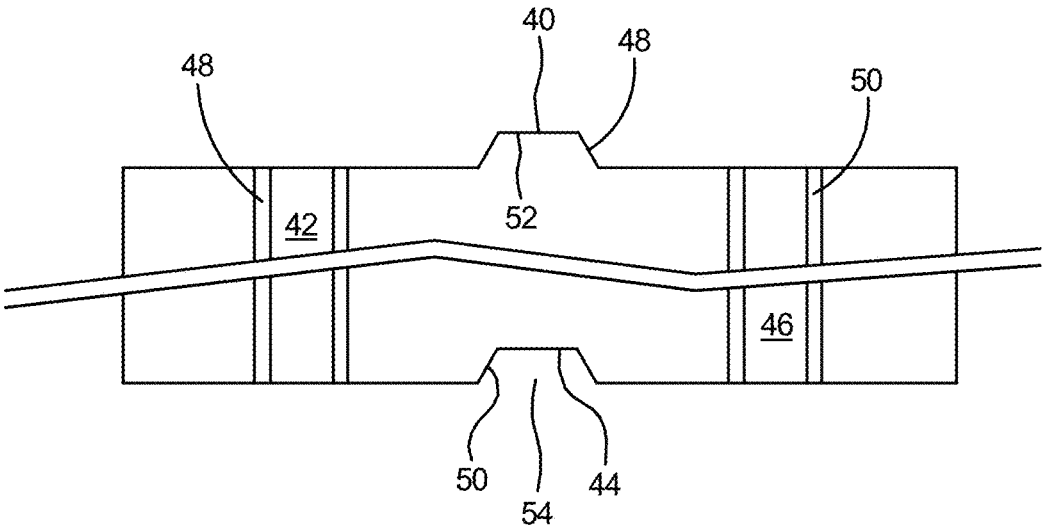
FIG. 3A is a detail view depicting a shear lug and complimentary groove in the block of FIG. 2.
Figure 4:
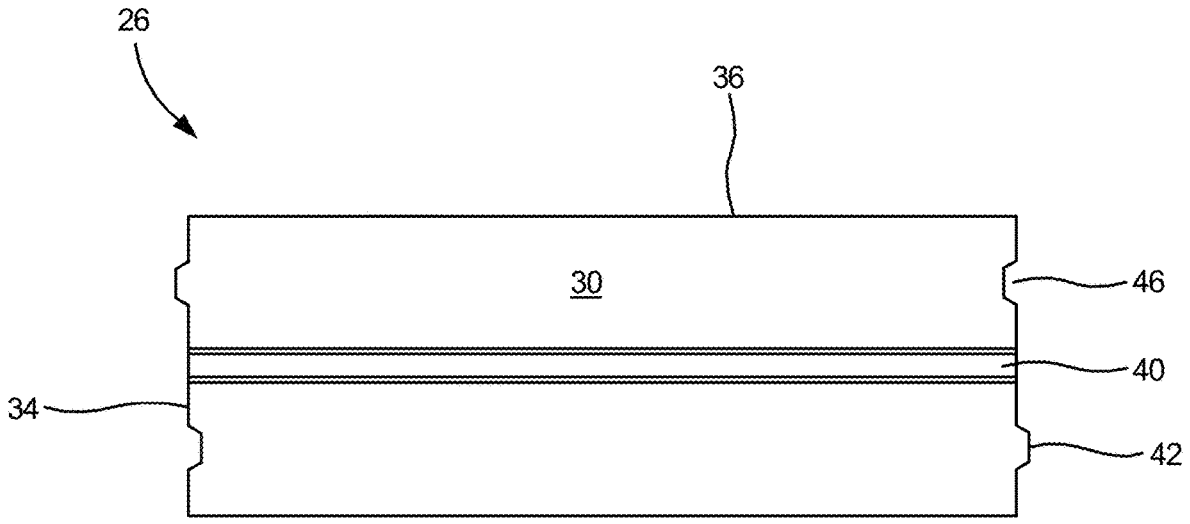
FIG. 4 is a top view of the block.

With reference to FIGS. 3 and 3A, both the top shear lug 40 and end shear lugs 42 preferably include beveled sidewalls 48 and the grooves 44 and 46 preferably included beveled sidewalls 50. The shear lugs and grooves are thus substantially trapezoid-shaped as viewed from their ends. The beveled sides of the shear lugs and grooves, as well as the fact that the farthest outward surface 52 of the shear lugs is smaller than the entry 54 of the grooves, enables rapid end-to-end joining of blocks and rapid dry-stacking of successive rows of blocks as the beveled sidewalls 48 of the shear lugs easily find and fit into the respective grooves.

Referring to FIG. 2, the end shear lugs 42 on each end 34 of the block 26 are on opposite sides of the end, making one end a mirror image of the opposing end. This arrangement gives a distinct advantage when dry-stacking a plurality of blocks as the block need not be rotated 180° on its bottom surface 32 in order to slide it into engagement with an adjacent block in a dry-stacked structure. Thus, an installer can quickly remove blocks from a pallet and stack them into a wall without needing to rotate any individual block into the proper orientation.

Most preferably, a substantially linear trench is dug in the floor of the mine tunnel to accommodate poured concrete for the forming of a base 22 with a level surface 24. Conventional means, such as 2×6-inch boards, can be used to build a form for containing the concrete pour and obtaining the level surface. Furthermore, the concrete base can be formed at a height such that the subsequent rows of blocks will approximately top out substantially even with the mine roof. As mine roofs typically settle with time, the newly formed mine seal will eventually be held in place by overhead pressure.

Figure 7:
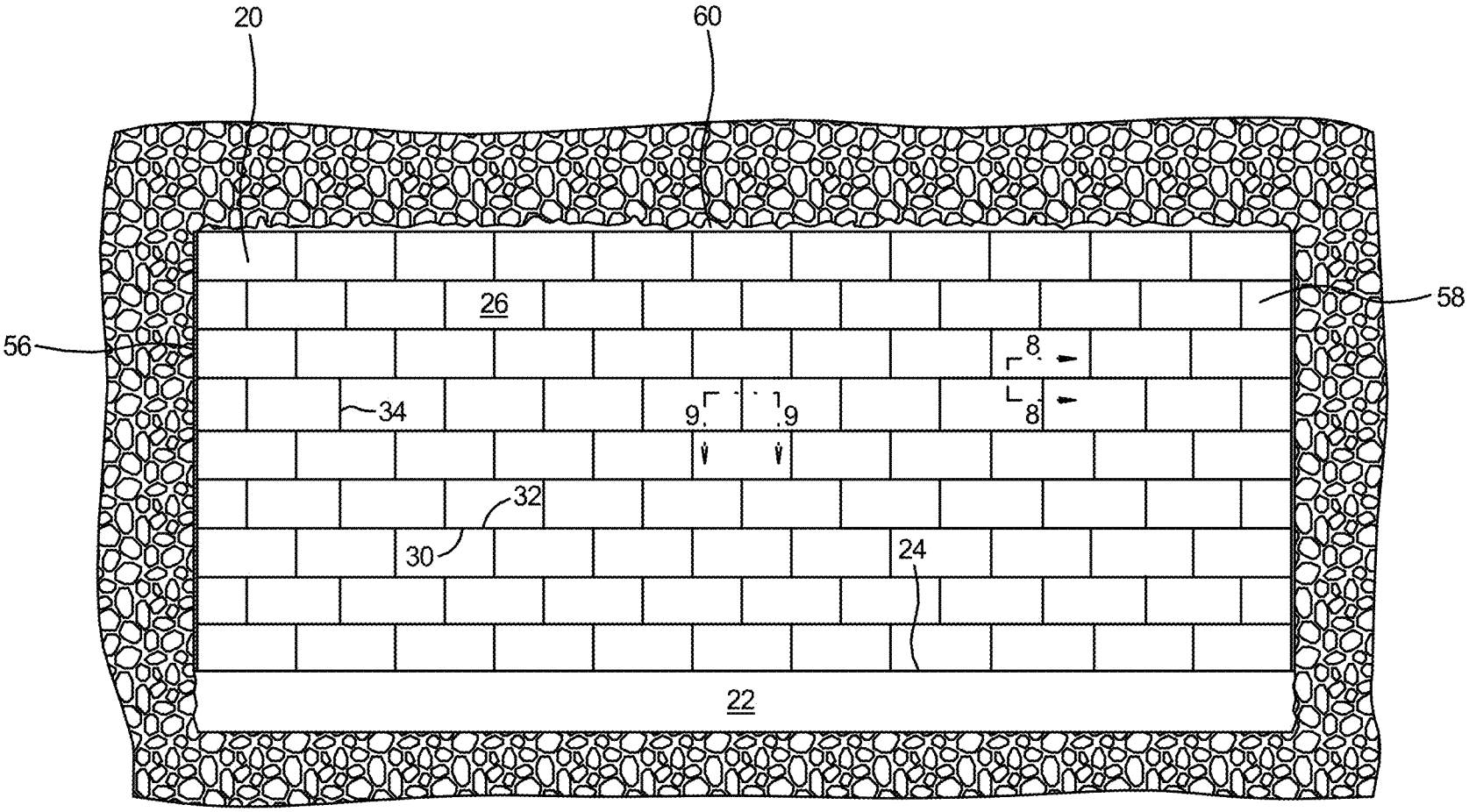
FIG. 7 is a front elevation view of a mine seal within a mine entrance constructed with a plurality of concrete blocks according to the present invention.
Figure 9:
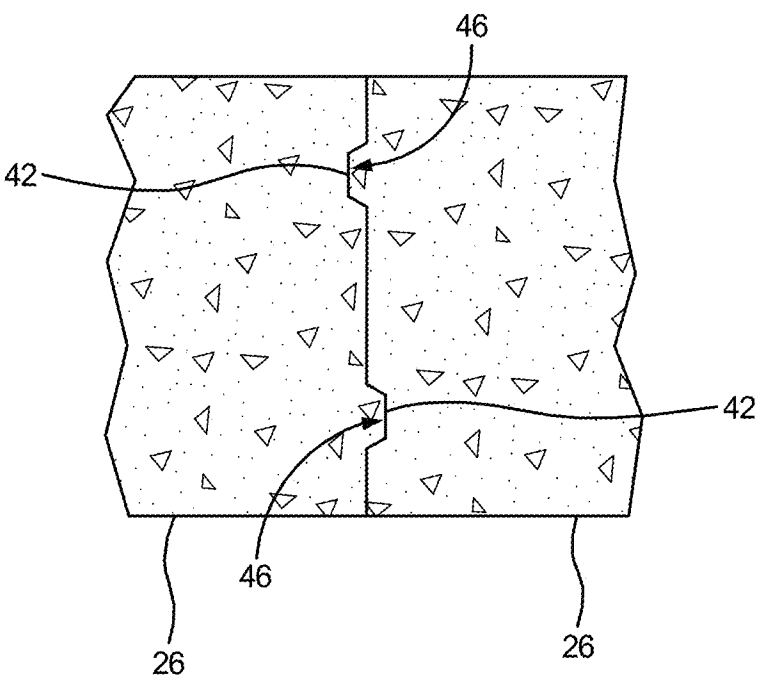
FIG. 9 is a sectional view of a portion of the mine seal of FIG. 7 taken along line 9-9 of FIG. 7.
Figure 8:
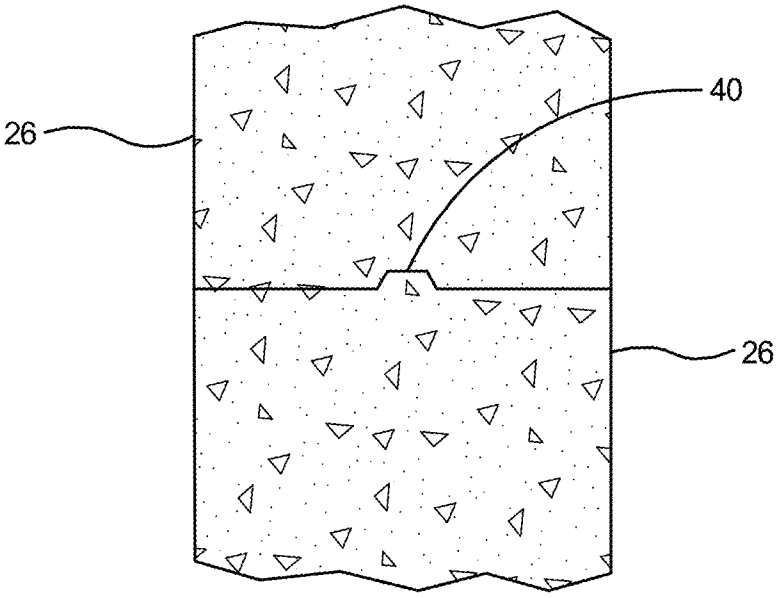
FIG. 8 is a sectional view of a portion of the mine seal of FIG. 7 taken along line 8-8 of FIG. 7.

With reference to FIG. 7, a plurality of blocks 26 according to the invention are dry-stacked on level surface 24 of base 22 to form a mine seal 20 within a mine entrance or tunnel 56. In a mine seal 20 according to the present invention, half-length blocks 58 may be used if desired or strictly full-length blocks 26 to block the mine entrance 56. The level surface 24 of base 24 maintains each succeeding row of blocks level and horizontally aligned with the row or rows below it. Most preferably, sealing materials 60 such as wood planks, foam, or similar materials can be used to seal any air spaces between the seal 20 and the tunnel roof or walls. Preferably, any air spaces may be filled with a coating of MSHA-certified sealant, such as SILENT SEAL® available from Fomo Products, Inc. of Norton, Ohio. Furthermore, the exposed surfaces of either wall may be coated with a conventional MSHA flame retardant sealant layer, such as BBOND® available from Quikrete International, Inc. of Atlanta, Ga.

As the ends of the blocks 26 of the present invention are mirror-images of each other, any block can be swapped end-to-end without regard to fitting into the mine seal structure as each subsequent row of blocks is dry-stacked. The beveled sides of the shear lugs 40 and 42 and grooves 44 and 46, as well as the fact that the farthest outward surface 52 of the shear lugs is smaller than the entry 54 of the grooves (see FIG. 3A), enables rapid end-to-end joining of blocks and rapid dry-stacking of successive rows of blocks as the beveled sidewalls 48 of the shear lugs 40 and 42 easily find and fit into the respective grooves 42 and 44. As shown in FIG. 7, the dry-stacked blocks 26 are slid together end-to-end, with the end surfaces 34 of each adjacent block flush with each other and the bottom surface 32 of any block in an upper row flush with the top surfaces 30 of any adjacent row of blocks below it. Furthermore, the shear lugs 40 on the top of each block 26 and the shear lugs 42 on the ends 34 of each block interlock with their respective grooves 44 and 46 thereby provide a substantial increase in resistance to a shear force or sideways pressure P (see FIG. 6) against either face 62 of the mine seal 20.

Figure 6:
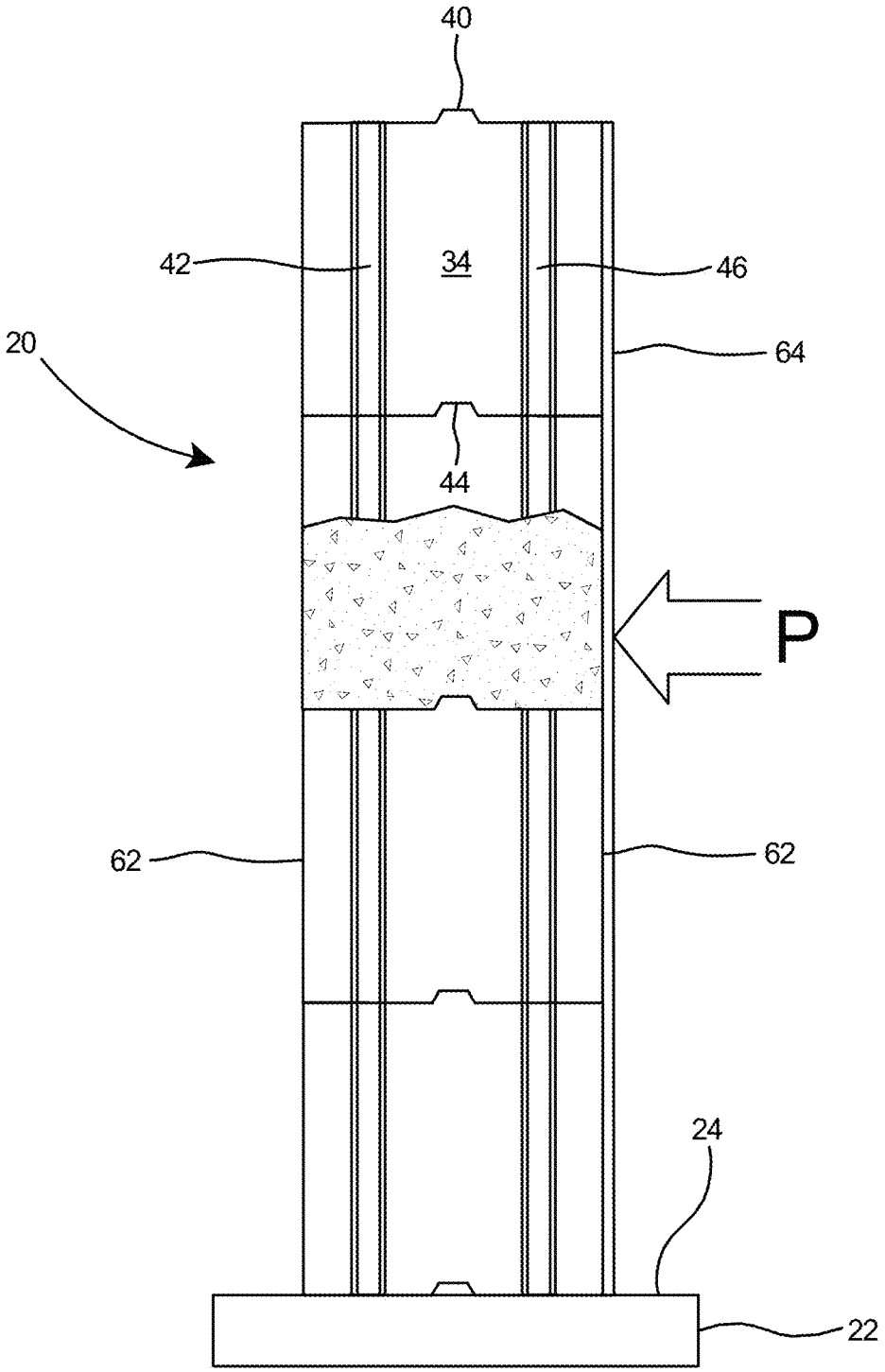
FIG. 6 is an end view of a portion of the mine wall of FIG. 1.

With reference to FIG. 6, the interlocking shear lugs between all upper and lower surfaces of adjacent blocks and between all end surfaces of adjacent blocks form an effective mine seal that is substantially impervious to air penetration, which property is beneficial when a mine wall is erected as a ventilation wall. When a mine wall is erected to serve as a mine seal 20, the interlocking shear lugs 40 and 42 enable the wall to resist a substantial a displacement force or shear force P (see FIG. 6). The high shear strength is achieved without the use of reinforcement rods or masonry anchors.

Figure 10:
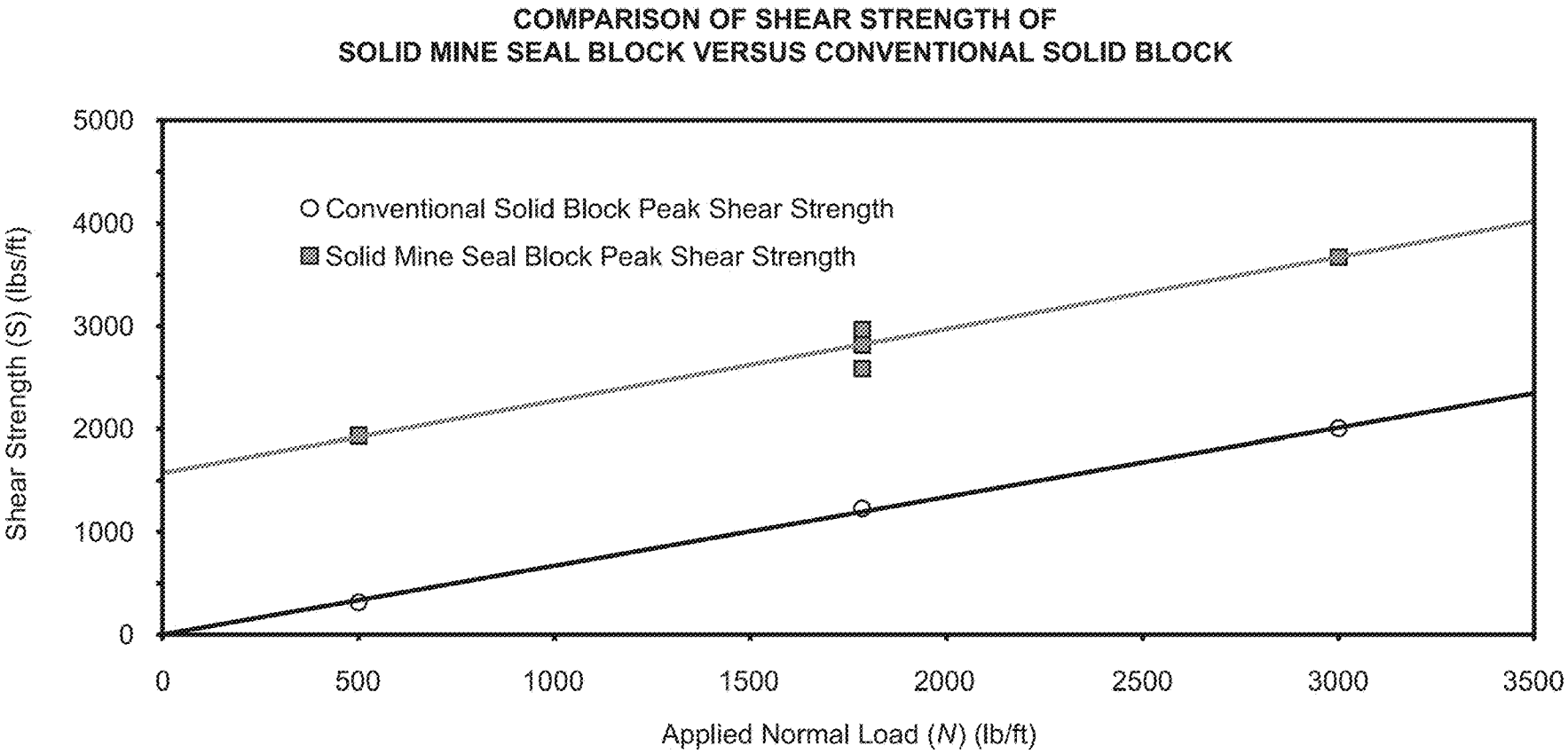
FIG. 10 is a graph depicting a comparison of shear strengths of a mine seal constructed of conventional solid concrete blocks versus a mine seal or mine stopping constructed of the preferred embodiment of block according to the present invention.
Figure 11:
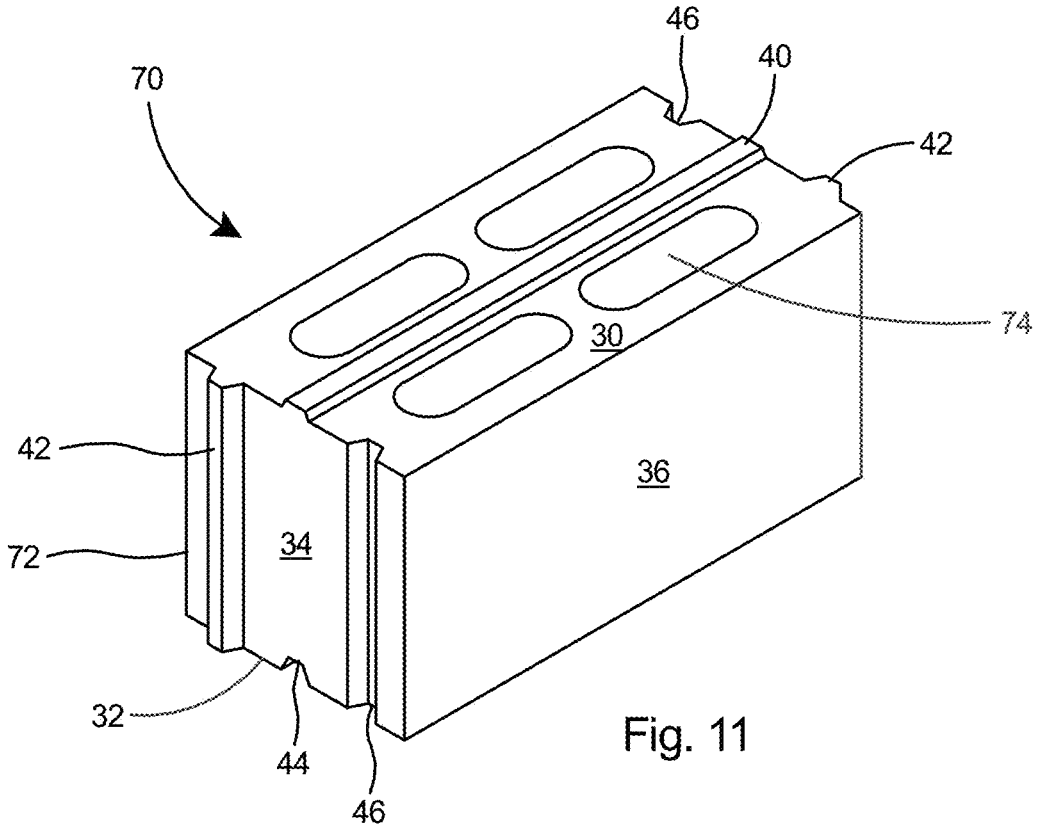
FIG. 11 is a top isometric view of a second and preferred embodiment of a stretcher block according to the invention.
Figure 12:
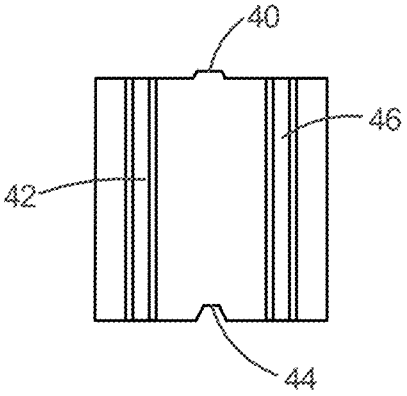
FIG. 12 is an end view of the stretcher block.
Figure 13:
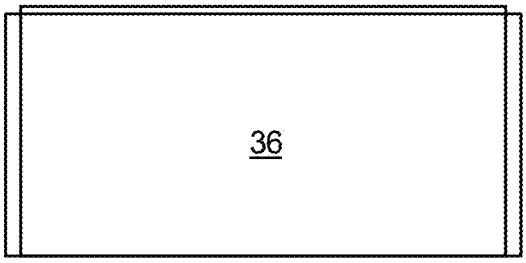
FIG. 13 is a side view of the stretcher block.
Figure 14:
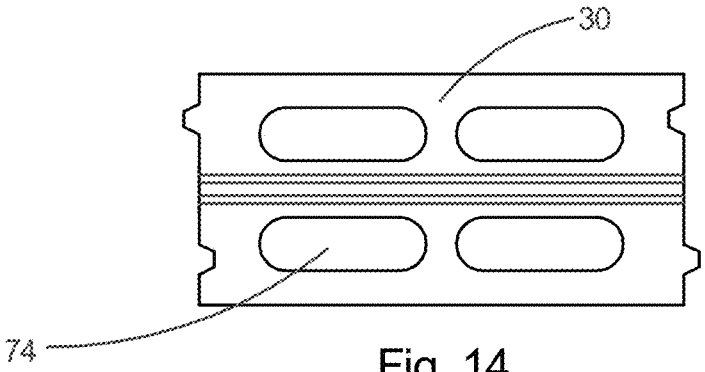
FIG. 14 is a top view of the stretcher block.
Figure 15:
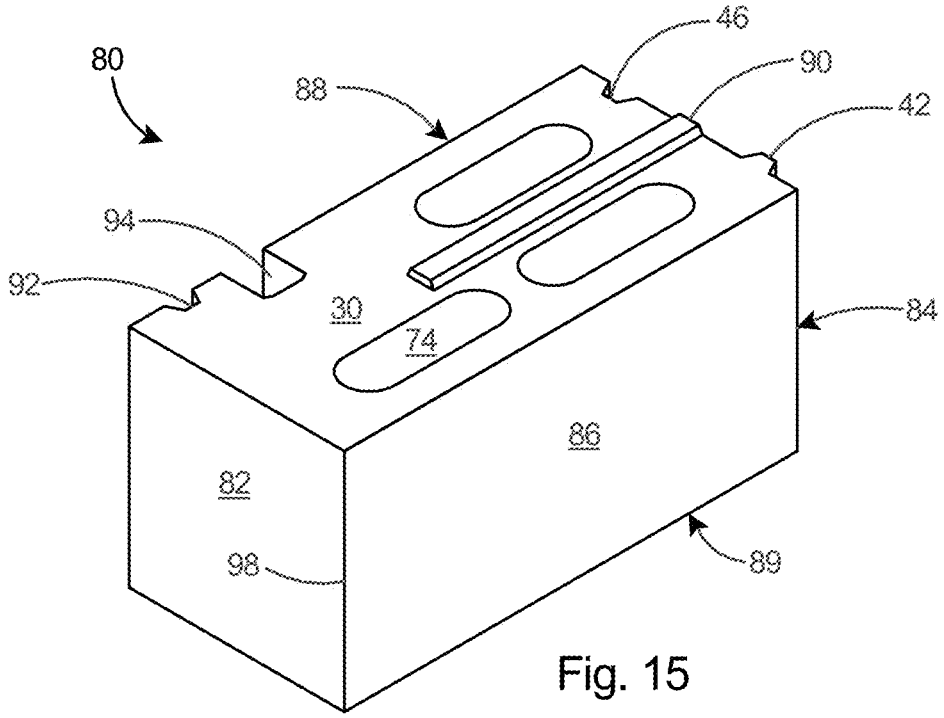
FIG. 15 is a top isometric view of a right corner block according to the invention.
Figure 16:
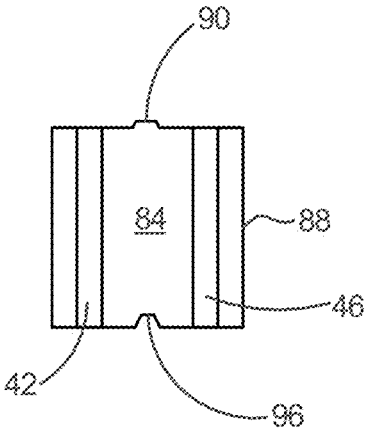
FIG. 16 is an end view of the right corner block.

Mine seals are constructed to permanently seal off mined-out portions of a mine from the active mine. It is critical that such mine seals exhibit high shear strength or a strong resistance to a transverse load. A transverse load is defined as deflection from pressure exerted on one side of the seal, for example an explosion. For testing purposes, several mine seals were constructed with 1) conventional solid concrete blocks (control condition), and several with 2) mine seal blocks according the present invention (test condition) (see FIG. 2). Resistance to transverse loads varies with the normal load applied at the top of the mine seal. Both sets of mine seals were tested at normal loads of 500, 1750, and 3000 lbs/ft. As shown in FIG. 10, a mine seal constructed with mine seal blocks according to the present invention recorded substantially higher shear strength at each of the three normal load conditions. The shear strength for both the control and test condition increased substantially linearly with the normal load. A wall constructed with the mine seal block of the present invention recorded on average 1600 lbs/ft higher shear strength at a given applied normal load than a wall constructed of conventional solid concrete blocks. According to the present invention, the mine seal of the present invention can withstand a shear strength of at least 1900 pounds per foot (lbs/ft) under an applied normal load of 500 lbs/ft, a shear strength of at least 2700 pounds per foot (lbs/ft) under an applied normal load of 1750 lbs/ft, and a shear strength of at least 3600 pounds per foot (lbs/ft) under an applied normal load of 3000 lbs/ft.

As shown in FIG. 2 the blocks 26 of the present invention include a self-aligning structure. The single top shear lug 40 and the complimentary longitudinal groove 44 along the bottom surface 32 ensure that, when forming a mine seal, the blocks in each upper row align properly with the blocks there below to form a perfectly aligned vertical wall.

With reference to FIGS. 11-14, there is shown an interlocking stretcher block 70 for use in constructing a mine stopping, permanent mine seal, safe room, or mine support. The stretcher block 70 includes a body 72 with a top surface 30, bottom surface 32, end surfaces 34, and side surfaces 36. The top, bottom, end, and side surfaces 30, 32, 34, and 36 are each substantially planar. A top shear lug 40 extends longitudinally along the top surface 30 and an end shear lug 42 extends vertically along each end 34 of the block. A bottom groove 44 extends longitudinally along the bottom surface 32 of the block 26 and an end groove 46 extends vertically along each end surface 34. The stretcher block 70 further may include one or more hollow cores 74 extending vertically through the block. The stretcher block 70 is of generally rectangular prism shape and the block has a rotational symmetry when rotated 180 degrees. The meaning of the term "rectangular prism shape" as used herein is "a solid object which has six faces that are rectangles, having the same cross-section along a length, which makes it a prism". The meaning of the term "rotational symmetry" as used herein is "a shape that still looks the same after some rotation". The top shear lug 40 and end shear lugs 42 of the stretcher block 70 are configured such that they engage complimentary bottom and end grooves in adjacent self-similar blocks thereby enabling consecutive blocks to self-align vertically and lock together when stacked. The stretcher blocks are thus configured to be quickly dry-stacked although they can also be used with mortar if preferred.

Figure 17:
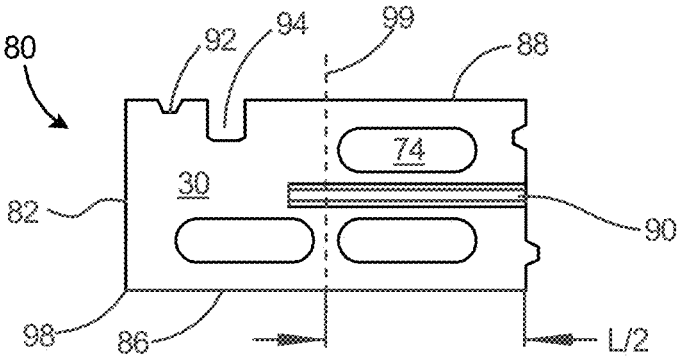
FIG. 17 is a top view of the right corner block.
Figure 18:
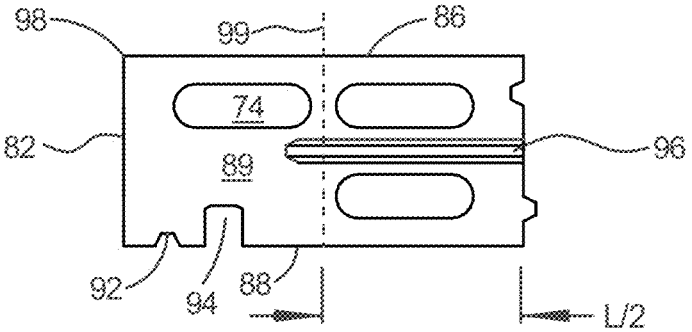
FIG. 18 is a bottom view of the right corner block.
Figure 19:
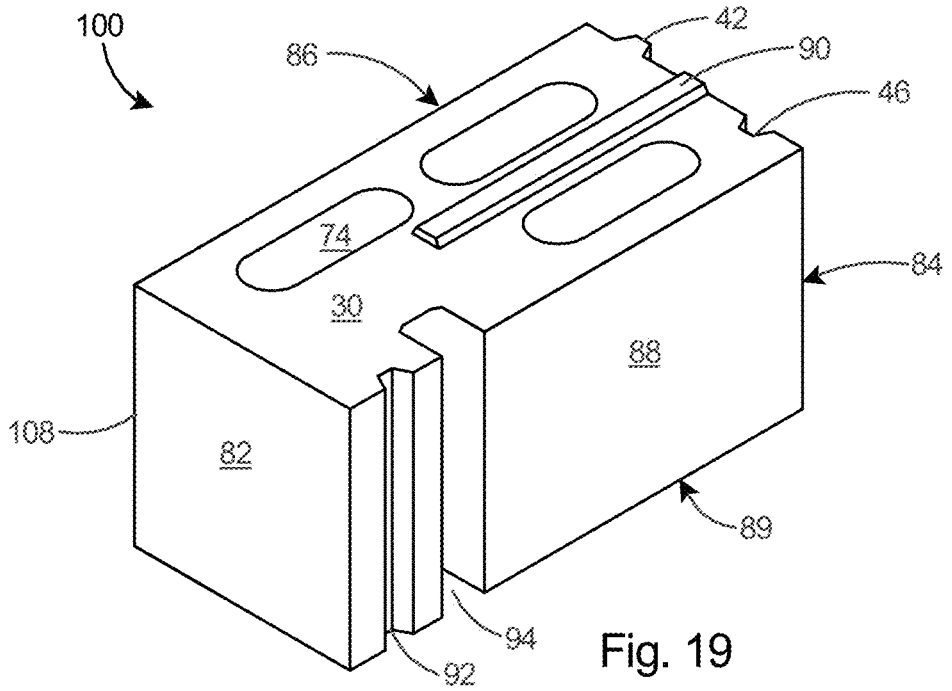
FIG. 19 is a top isometric view of a left corner block according to the invention.
Figure 20:
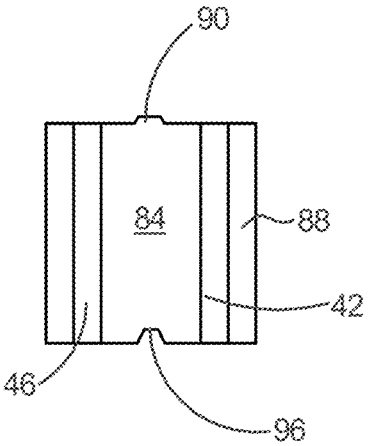
FIG. 20 is an end view of the left corner block.
Figure 21:
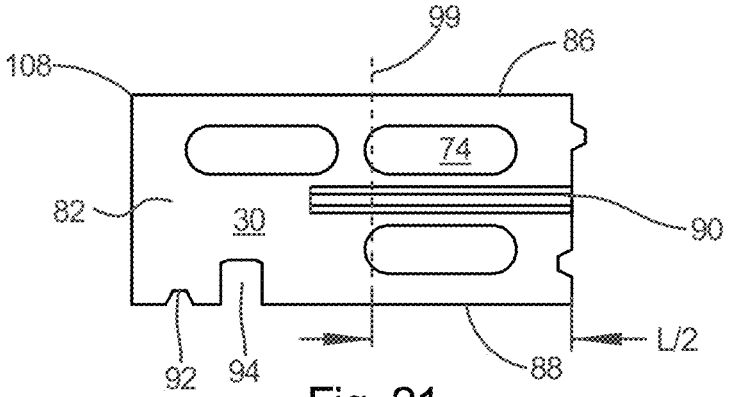
FIG. 21 is a top view of the left corner block.
Figure 22:
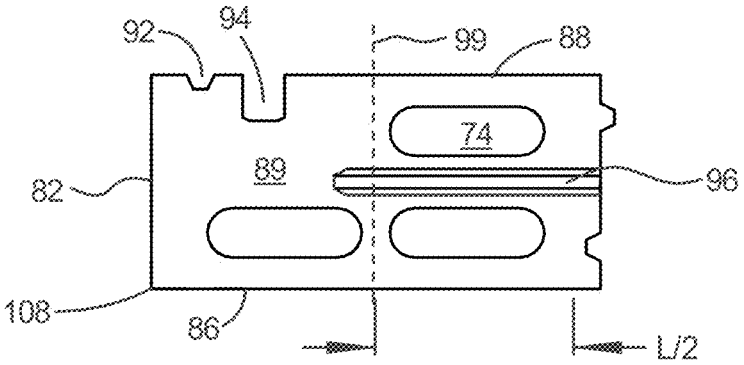
FIG. 22 is a bottom view of the left corner block.
Figure 23:
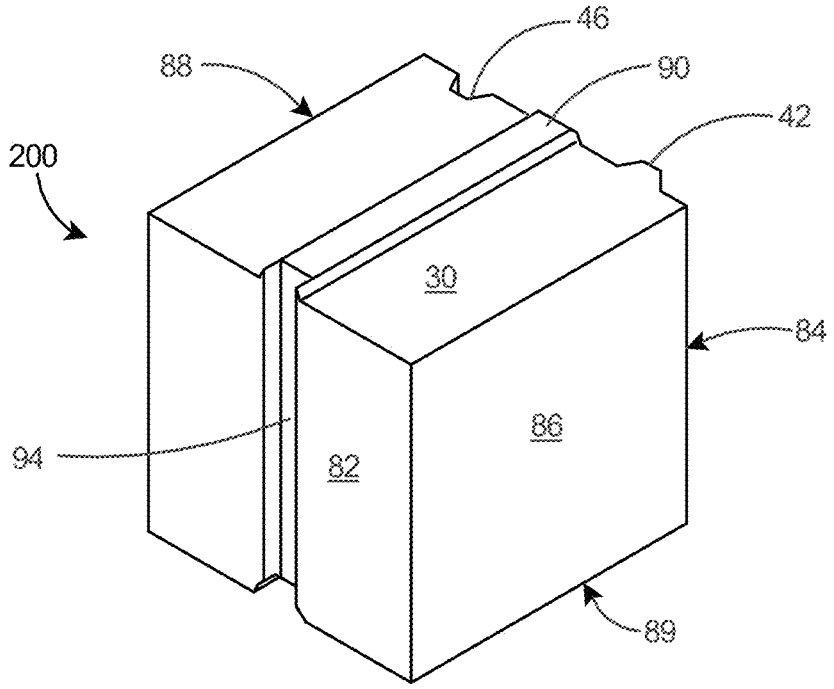
FIG. 23 is a top isometric view of a half block according to the invention.
Figure 24:
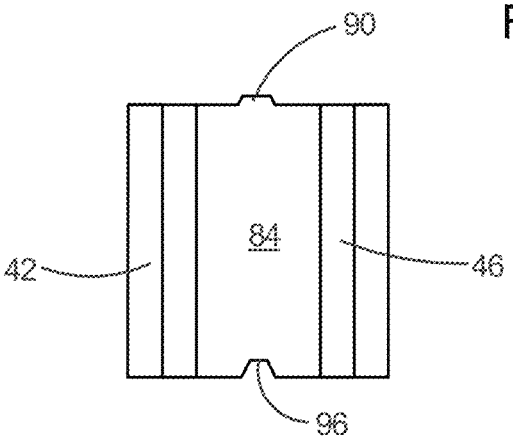
FIG. 24 is an end view of the half block.
Figure 25:
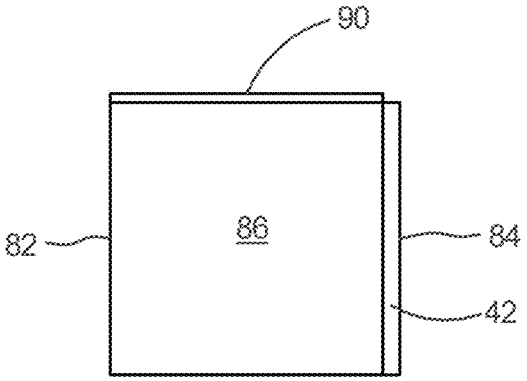
FIG. 25 is a side view of the half block.
Figure 26:
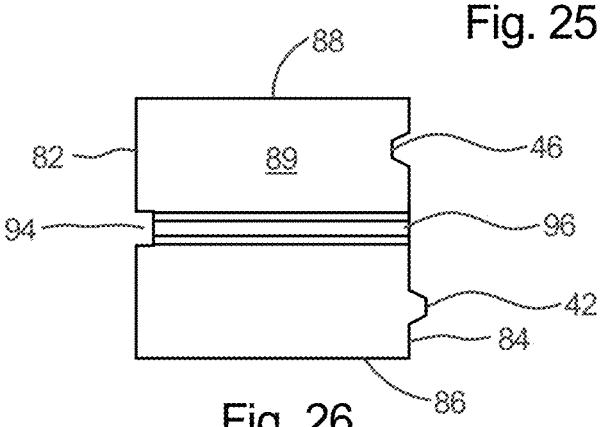
FIG. 26 is a top view of the left corner block.

Referring to FIGS. 15-18, the right hand corner block 80 includes a top 30, an outer end 82, an inner end 84, an outer side 86, an inner side 88, and a bottom 89. Right hand corner block further includes a top lug 90, a side groove 92, a notch 94, a bottom groove 96, and a right hand corner 98. As shown in FIGS. 17 and 18, the top lug 90 and bottom groove 96 each extend along their respective sides from the inner end 84 of the block and extend past the center line 99 of the block 80. The right hand corner 98 of the block is the corner between the face end 82 and outer side 86, which, when mated to a stretcher block 70 (see FIG. 11) will form an outside corner on a wall. Right hand corner 98 extends along the right side of the face end 82, at the juncture of the face end 82 and outer side 86. The right hand corner 98 will thus be adjacent the outer side 86 of the block 80 and the inner side will include the side groove 92 for mating with a stretcher block. The notch 94 of the right hand corner block 80 is on the right side of the inner side 88 of the block.

Top lug 90 and bottom groove 96 extend from the inner end 84 of block 80 to a distance more than halfway through the length of the block, or past the center 99 of the block, with the half-length of the block indicated by L/2 in FIGS. 17 and 18. When laid as an upper course on a lower course of blocks, notch 94 will provide clearance for the top shear lug 40 of the stretcher block in the lower course. As shown in FIGS. 17 and 18, the top lug 90 and bottom groove 96 each extend along their respective sides from the inner end 84 of the block and extend past the center line 99 of the block 80. The right hand corner 98 of the block is the corner between the face end 82 and outer side 86, which, when mated to a stretcher block 70 (see FIG. 11) will form an outside corner on a wall.

With reference to FIGS. 19-22, the left hand corner block 100 will also include a top 30, an outer end 82, an inner end 84, an outer side 86, an inner side 88, a bottom 89, a top lug 90, a bottom groove 96, a side groove 92 and a notch 94. Left hand corner block 100 further includes a left hand corner 108 along the left side of face end 82. The left hand corner 108 is the corner between the face end 82 and outer side 86, which, when mated to a stretcher block 70 (see FIG. 11) will also form an outside corner on a wall. Left hand corner 108 extends along the left side of the face end 82. As shown in FIG. 18, the notch 94 of the right hand corner block 80 is on the right side of the inner side 88 of the block. The notch 94 of the left hand corner block 100 is on the left side of the inner side 88 of the block.

Referring to FIGS. 23-26, a half block 200 according to the invention includes a top lug 90 extending along the top 30 of the block and a bottom groove 96 extending along the bottom 89. The inner end 84 includes an end shear lug 42 and an end groove 46. A notch 94 extends vertically along the outer end.

Figure 27:
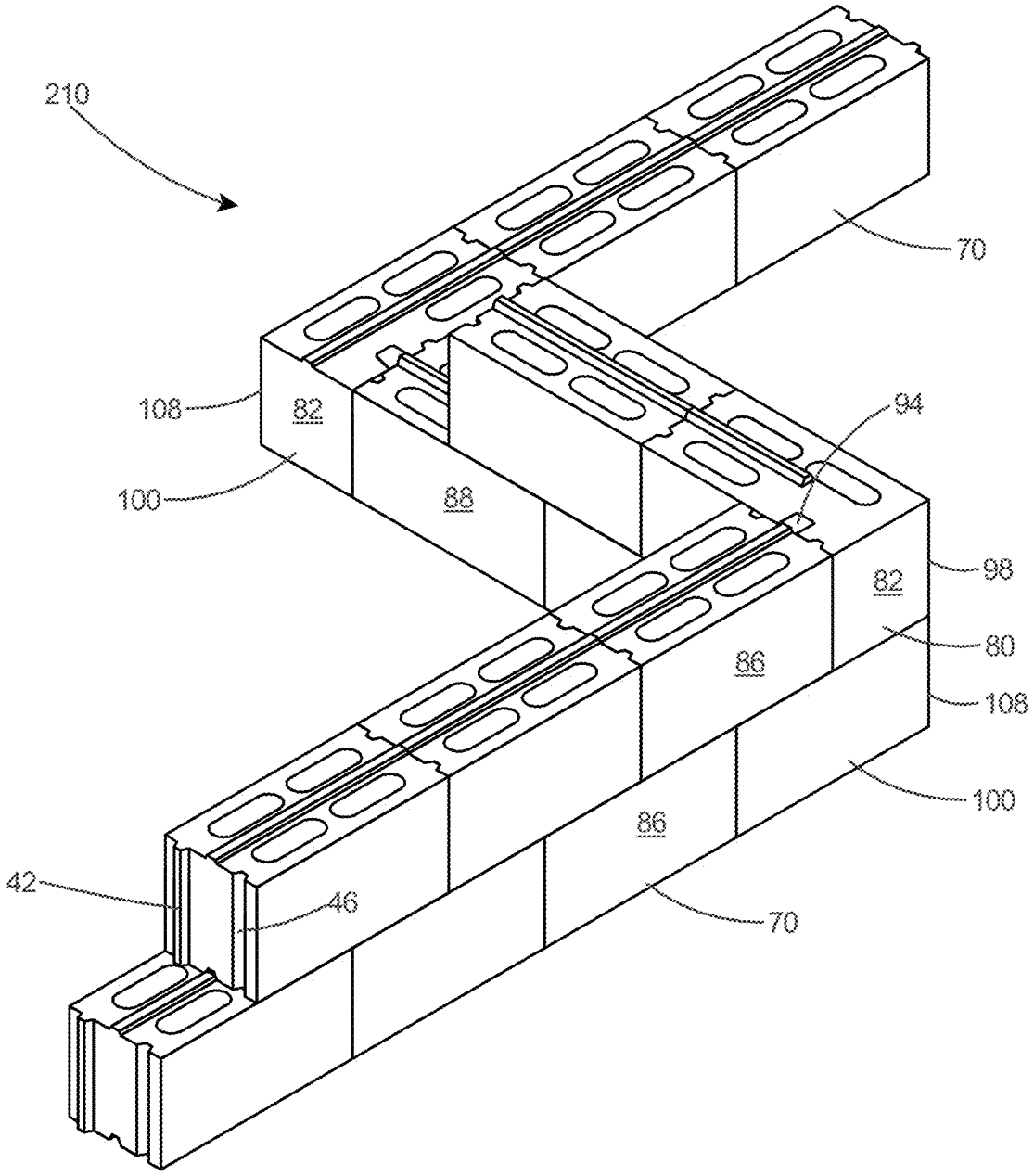
FIG. 27 is a top isometric view of a wall constructed with the stretcher blocks, right corner block blocks, and left corner blocks of the invention.

With reference to FIG. 27, there is shown a wall 210 constructed with the stretcher blocks 70, right corner block blocks 80, and left corner blocks 100 of the invention. The corner blocks 80 and 108, provide a means for creating a corner and redirecting a course of blocks by 90 degrees. The stretcher blocks 70 are laid end to end to form straight wall sections. A left corner block 100 is used to form a left hand corner 108 and a wall section at 90 degrees to the straight wall section. A second course is laid upon the bottom course and a right corner block 80 is used to form a right hand corner 98 and create a second course to overlay the bottom course. Additional blocks can be laid in a similar manner, with stretcher blocks 70 and left corner blocks 100 in the odd courses and stretcher 70, and right corner blocks 80 in the even courses of the wall 210 until the desired wall height is reached.

Figure 28:
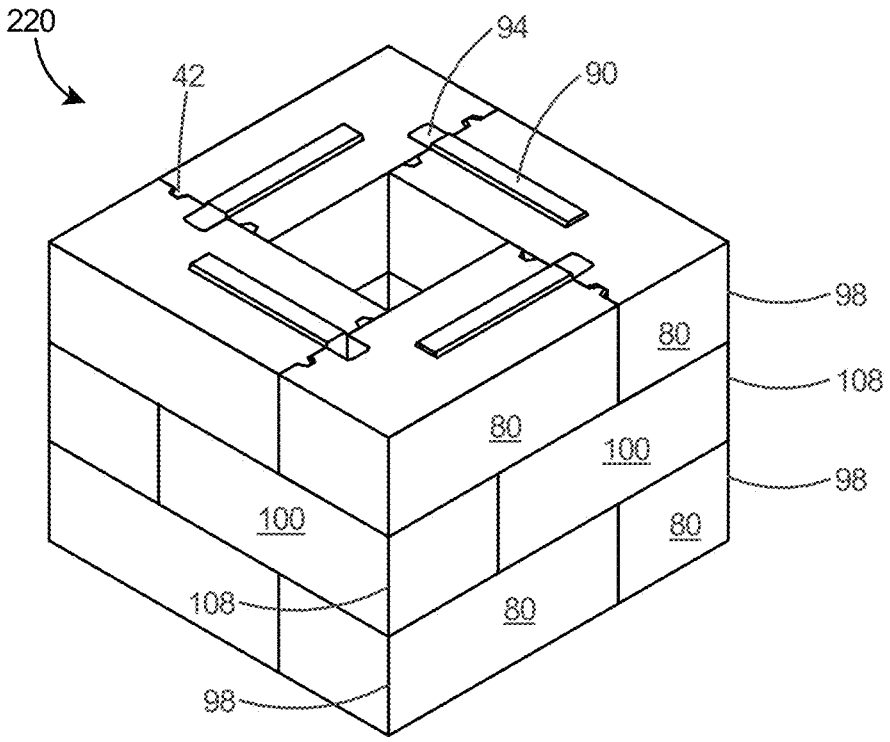
FIG. 28 is a top isometric view of a mine support or crib column constructed with the right corner block blocks and left corner blocks of the invention.
Figure 29:
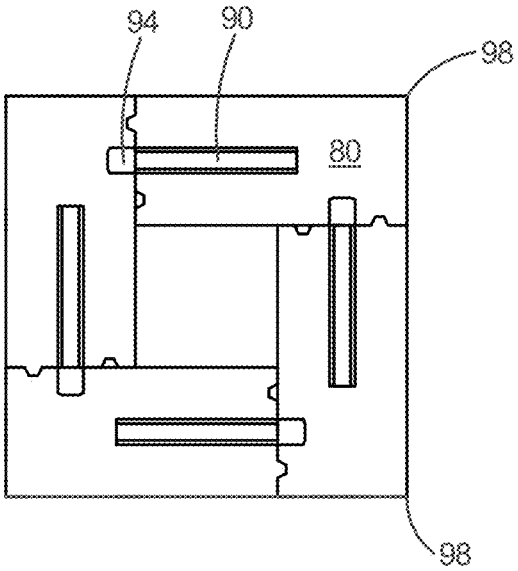
FIG. 29 is a top view of an odd course of the mine support or crib column of FIG. 29.
Figure 30:
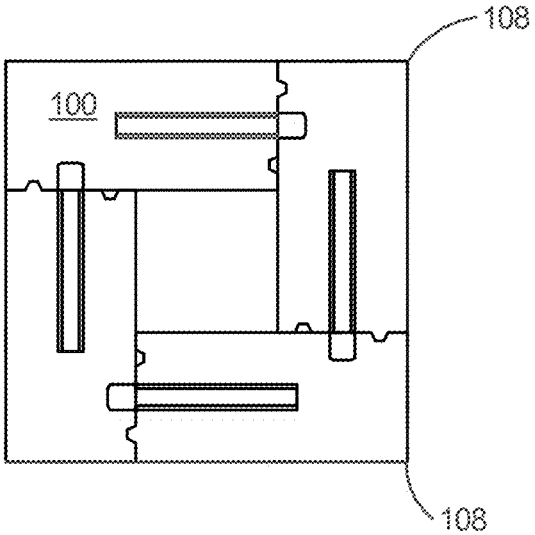
FIG. 30 is a top view of an even course of the mine support or crib column of FIG. 29.

Referring to FIGS. 28-30, a mine support or crib column 220 is constructed with the right hand corner block blocks 80 and left hand corner blocks 100 of the invention. The odd courses of blocks are formed with right corner blocks 80 and the even courses are formed left hand corner blocks 100. The column 220 could also be constructed with the left hand corner blocks 100 forming odd courses and the right hand corner block blocks 80 forming even courses. The use of right hand corner blocks 80 in the odd courses and left hand corner blocks 100 in the even courses is for illustration purposes as it is within the scope of the invention to provide left hand corner blocks 100 in the odd courses and right hand corner blocks 80 in the even courses.

Figure 31:
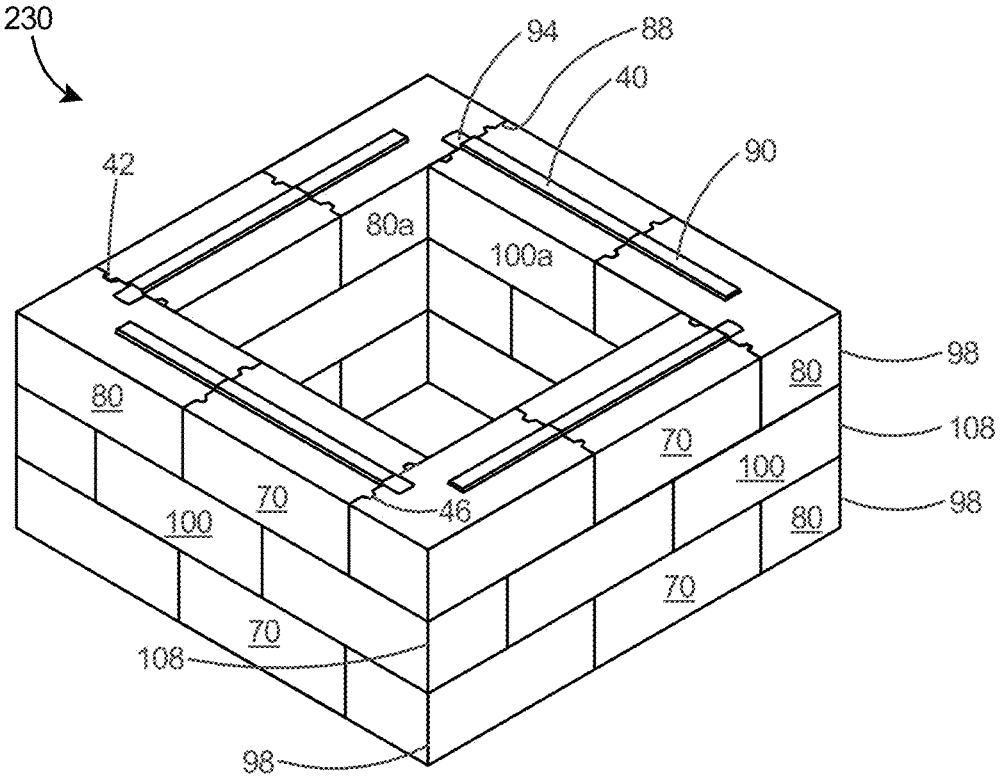
FIG. 31 is a top isometric view of a mine support or crib column constructed with the stretcher blocks, right corner block blocks, and left corner block of the invention.
Figure 32:
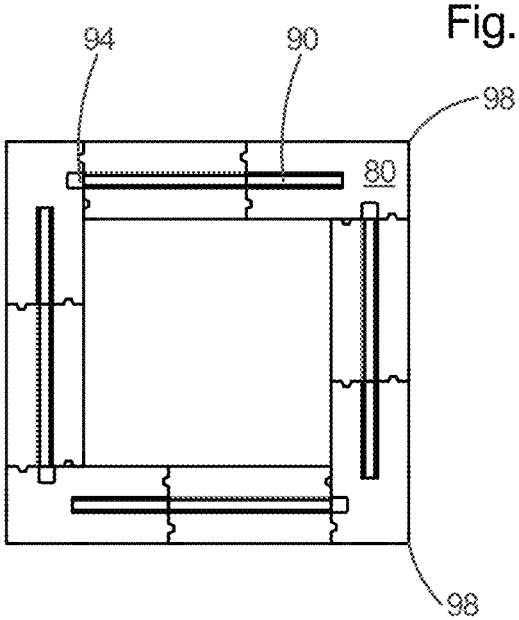
FIG. 32 is a top view of an odd course of the mine support or crib column of FIG. 32.
Figure 33:
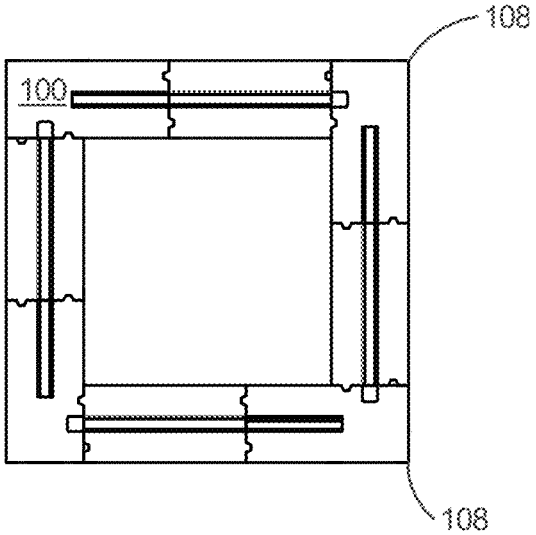
FIG. 33 is a top view of an even course of the mine support or crib column of FIG. 32.

With reference to FIGS. 31-33, there is shown a mine support or crib column 230 constructed with the stretcher blocks 70, right corner block blocks 80, and left corner 100 blocks of the invention. The odd courses in mine support or crib column 230 are constructed of stretcher blocks 70 and right corner block blocks 80. The even courses are constructed of stretcher blocks 70 and left corner block blocks 100. The top lug 90 of the underlying corner blocks 80 and 100 will extend more than one-half the length of the corner block. The notch 94 in the inner side 88 of each corner block, such as shown for block 80*a* for example, enables the overlapping of the underlying corner block 100*a*, thereby providing space to accommodate the top lug 90 of the underlying block.

The blocks 70, 80, 100, 200 of the wall construction system as described herein include a compression strength preferably from 1900 to 7000 psi, more preferably from 2300 to 5000 psi, and most preferably from 2500 to 3500 psi. The blocks are formed from a mix including an aggregate. The aggregate includes a particle size determined by sieve size. Preferably the sieve size used to classify the aggregate is from #12 to #7 sieve size and more preferably from #12 to #10 sieve size, which sieve sizes respectfully equate to a particle size of preferably 0.0661 inch to 0.5 inch (#12 to #7 sieve size) and more preferably to a particle size of preferably 0.0661 inch to 0.0787 inch (#12 to #10 sieve size). Controlling the particle size in the mix within the desired ranges maintains the overall integrity of the lugs.

As the invention has been described, it will be apparent to those skilled in the art that the embodiments shown herein may be varied in many ways without departing from the spirit and scope of the invention. Any and all such modifications are intended to be included within the scope of the appended claims.

What is claimed is:

1. A wall construction system comprising:

a stretcher block including a body having a top surface, and a bottom surface, said ends at 90 degrees to said top surface and said bottom surface forming a generally rectangular prism shape;

the stretcher block including an inner end and an outer end, an inner side and an outer side, a top shear lug, and a bottom groove;

an end shear lug and an end groove extending vertically along the ends of the stretcher block, said end groove offset from and parallel to said end shear lug;

a corner block including a top and an inner end having a lug and a groove to mate with an end of the stretcher block;

the end shear lugs and grooves arranged on the ends of said stretcher block such that, when looking down at the top surface, the block has a rotational symmetry when rotated 180 degrees; and the top and end shear lugs of said stretcher block are configured such that they engage complimentary bottom and end grooves in adjacent self-similar blocks thereby enabling consecutive blocks to self-align vertically and lock together when stacked.

2. The wall construction system of claim 1 wherein said corner block includes an outer end and an outer side.

3. The wall construction system of claim 2 wherein said corner block includes an outside corner between the outer end and the outer side of the block.

4. The wall construction system of claim 3 wherein said corner block includes a notch and groove on said inner side of the block.

5. The wall construction system of claim 4 wherein said corner block includes a right hand corner block and a left hand corner block.

6. The wall construction system of claim 5 wherein the outside corner of the right hand corner block is on the right side of the outer end of the block.

7. The wall construction system of claim 5 wherein the outside corner of the left hand corner block is on the left side of the outer end of the block.

8. The wall construction system of claim 5 wherein the notch of the right hand corner block is on the right side of the inner side of the block.

9. The wall construction system of claim 5 wherein the notch of the left hand corner block is on the left side of the inner side of the block.

10. The wall construction system of claim 1 comprising a top lug on said corner block, said top lug extending along the top of the corner block from said inner end.

11. The wall construction system of claim 10 wherein said top lug on said corner blocks extends more than half the length of the corner block.

12. The wall construction system of claim 1 comprising said blocks including a compression strength of 1900 to 7000 psi.

13. The wall construction system of claim 1 comprising said blocks formed of an aggregate having a particle size of 0.0661 inch to 0.5 inch.

14. The wall construction system of claim 13 further comprising a half block having a top, two sides, an outer end, and an inner end.

15. The wall construction system of claim 14 wherein said half block further comprises:

a top lug on the top of the half block; and a notch on the outer end of the half block.

16. The wall construction system of claim 15 wherein said top lug and said notch of said are centered between said sides of said half block.

* * * * *